US007029249B2

(12) United States Patent
Bougamont et al.

(10) Patent No.: US 7,029,249 B2
(45) Date of Patent: Apr. 18, 2006

(54) ELECTRONIC MICRO-PUMP

(75) Inventors: Jean-Louis Bougamont, Eu (FR); Pierre Dumont, Eu (FR)

(73) Assignee: Rexam Dispensing Systems, (FR)

( * ) Notice: Subject to any disclaimer, the term of this patent is extended or adjusted under 35 U.S.C. 154(b) by 378 days.

(21) Appl. No.: 10/432,637

(22) PCT Filed: Dec. 11, 2001

(86) PCT No.: PCT/FR01/03917

§ 371 (c)(1),
(2), (4) Date: Jun. 10, 2003

(87) PCT Pub. No.: WO02/47826

PCT Pub. Date: Jun. 20, 2002

(65) Prior Publication Data

US 2004/0026461 A1 Feb. 12, 2004

(30) Foreign Application Priority Data

Dec. 12, 2000 (FR) ..... 00 16127

(51) Int. Cl.
*F04B 7/00* (2006.01)

(52) U.S. Cl. ..... 417/511; 417/415; 417/459; 417/568

(58) Field of Classification Search ..... 417/510, 417/511, 514, 444, 415, 459, 567, 568, 571
See application file for complete search history.

(56) References Cited

U.S. PATENT DOCUMENTS

| | | | | | |
|---|---|---|---|---|---|
| 3,187,960 | A | * | 6/1965 | Gorman | 222/321.9 |
| 3,532,446 | A | * | 10/1970 | Herreshoff | 417/511 |
| 4,245,967 | A | * | 1/1981 | Busselet | 417/510 |
| 4,740,141 | A | * | 4/1988 | Fekete | 417/259 |
| 4,784,584 | A | * | 11/1988 | Gruett | 417/399 |
| 5,188,519 | A | * | 2/1993 | Spulgis | 417/511 |
| 5,192,006 | A | * | 3/1993 | Van Brocklin et al. | 222/321.9 |
| 5,292,236 | A | * | 3/1994 | Graffin | 417/510 |
| 5,638,996 | A | * | 6/1997 | Montaner et al. | 222/321.2 |

* cited by examiner

*Primary Examiner*—William H. Rodriguez
(74) *Attorney, Agent, or Firm*—Bacon & Thomas, PLLC

(57) ABSTRACT

A micropump provided with a cylindrical body (1) containing a measuring chamber (10) defined by a piston (2) and communicating firstly with a tank via an inlet orifice (10*a*) provided with an inlet valve, and secondly with the outside via an outlet orifice (10*b*) provided with an outlet valve, the micropump being characterized in that the piston (2) is connected to an external reciprocating actuator, and in that at least one of said valves is constituted by a valve member (3, 6, 7) suitable for being driven in translation by friction contact with said piston (2) successively in one direction and then in the other, and whose stroke inside the chamber (10) is shorter than the stroke of said piston.

12 Claims, 6 Drawing Sheets

ELECTRONIC MICRO-PUMP

The present invention relates to an electronic micropump.

This pump is associated with a miniature electrical actuator and is for use in dispensing and/or metering out liquids such as perfumes, cosmetics, or pharmaceutical compositions.

The traditional pumps used for such applications generally comprise a cylindrical body containing a measuring chamber defined by a piston and communicating firstly with a tank via an inlet orifice provided with an inlet valve, and secondly with the outside via an outlet orifice provided with an outlet valve.

Such pumps are also provided with a pushbutton placed on top of a nozzle tube connected to the outlet valve and serving, when pressed down manually, to push the piston into the chamber to raise the pressure of the liquid.

However, in some cases it can be advantageous to motorize the operation of such pumps, if only to obtain greater comfort in use, by a continuous spray like that of an aerosol dispenser having a propellant gas.

Unfortunately, the structure of traditional pumps is not adapted to a continuous mode of operation, in particular because the valves have mechanical and hydraulic behavior that is incompatible with the usual frequencies for miniature electrical actuators such as motors, and in particular they have too much inertia.

An object of the present invention is to remedy those technical problems by modifying and adapting the structure of the pump to external reciprocating actuators.

According to the invention, this object is achieved by means of micropump characterized in that the piston is connected to an external reciprocating actuator, and in that at least one of said valves is constituted by a valve member suitable for being driven in translation by friction contact with said piston successively in one direction and then in the other, and whose stroke inside the chamber is shorter than the stroke of said piston.

According to an advantageous characteristic, said valve member comprises at least one wall for closing the outlet orifice or the inlet orifice periodically in leaktight manner.

In a variant, said wall is provided with a bead.

In a first embodiment, the outlet orifice is provided in the side wall of said body, and said valve element is constituted by a cylindrical and conical bushing having a bottom wall forming the inlet valve and a top side wall forming the outlet valve.

According to a specific characteristic, the bottom portion of said bushing includes at least one through slot.

According to another characteristic, the side wall of said bushing includes guide ribs in contact with the inside wall of the chamber.

Preferably, the internal portion of the piston is provided with side fluting and with a top lip providing sealing and a top-of-stroke abutment.

In a particular variant, the bottom wall and/or the top wall of the bushing carries a peripheral bead coming into leaktight abutment downwards or upwards, respectively as the case may be, against the wall of the chamber.

In a second embodiment, the outlet orifice opens axially into said chamber, and said valve member of the outlet valve is constituted by a rod engaged firstly with friction in a bore of the piston and provided secondly with a head having a transverse wall suitable for coming into leaktight engagement against the axial outlet orifice.

Preferably, said head is received inside a cavity whose transverse walls form end-of-stroke abutments.

In another embodiment, the inlet orifice is provided in the side wall of said body and the valve member of the inlet valve is constituted by a sleeve which has the internal portion of the piston engaged with friction contact therein.

Preferably, said sleeve co-operates with an annular shoulder formed in the inside wall of the body to limit its stroke.

The micropump of the invention provides a high degree of flexibility in use by allowing the liquid to be dispensed continuously and regularly because of the high operating frequencies of the actuator (of the order of 30 hertz (Hz) to 150 Hz).

The very fast movements of valve members take place without jolting because of the friction which performs braking.

By way of example, the friction connection may be obtained by implementing a small amount of radial clamping between the piston and the valve member.

The invention will be better understood on reading the following description given with reference to the drawings, in which.

Figure 1:
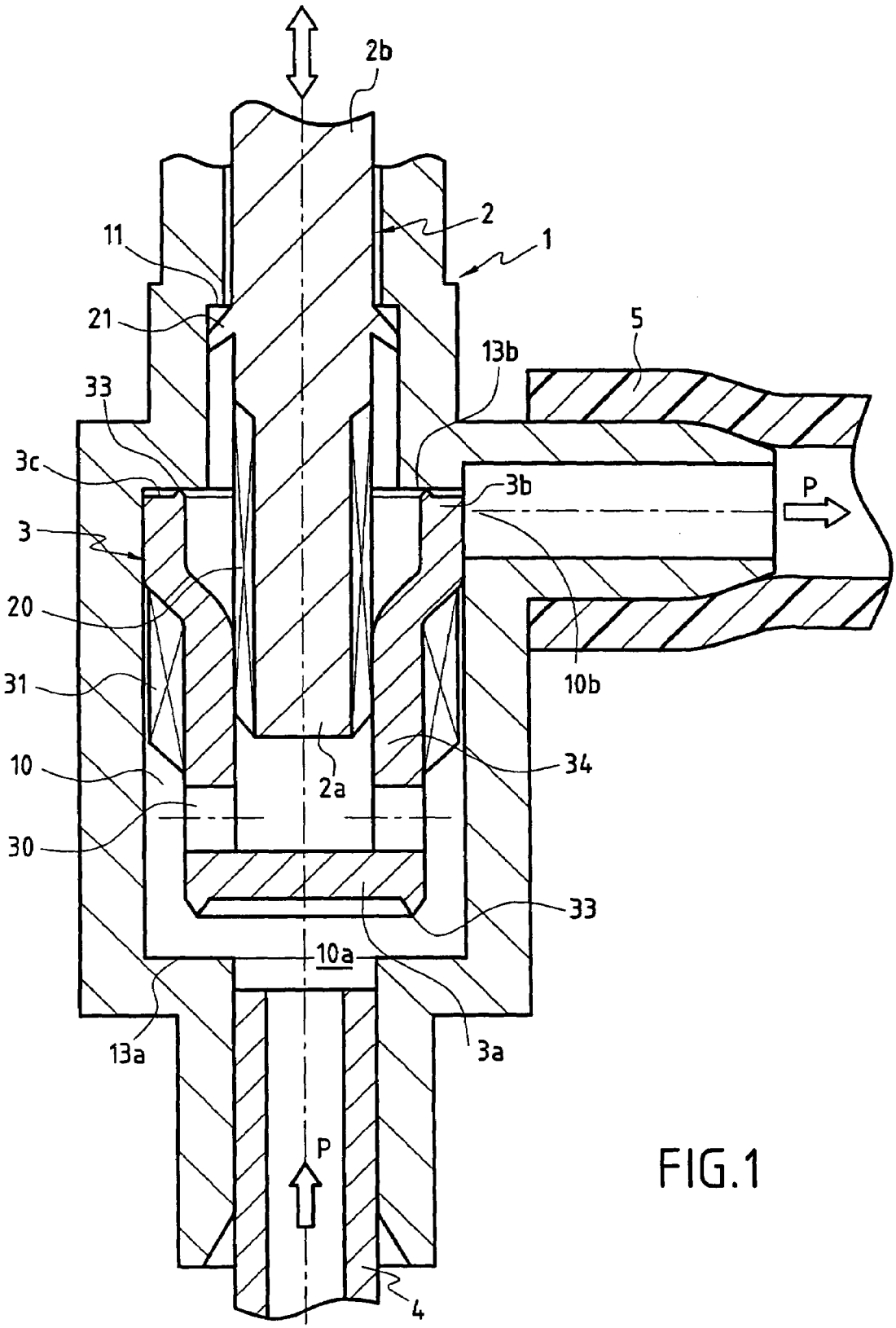
FIG. 1 is a diagrammatic section view of a first embodiment of the micropump of the invention.
Figure 3:
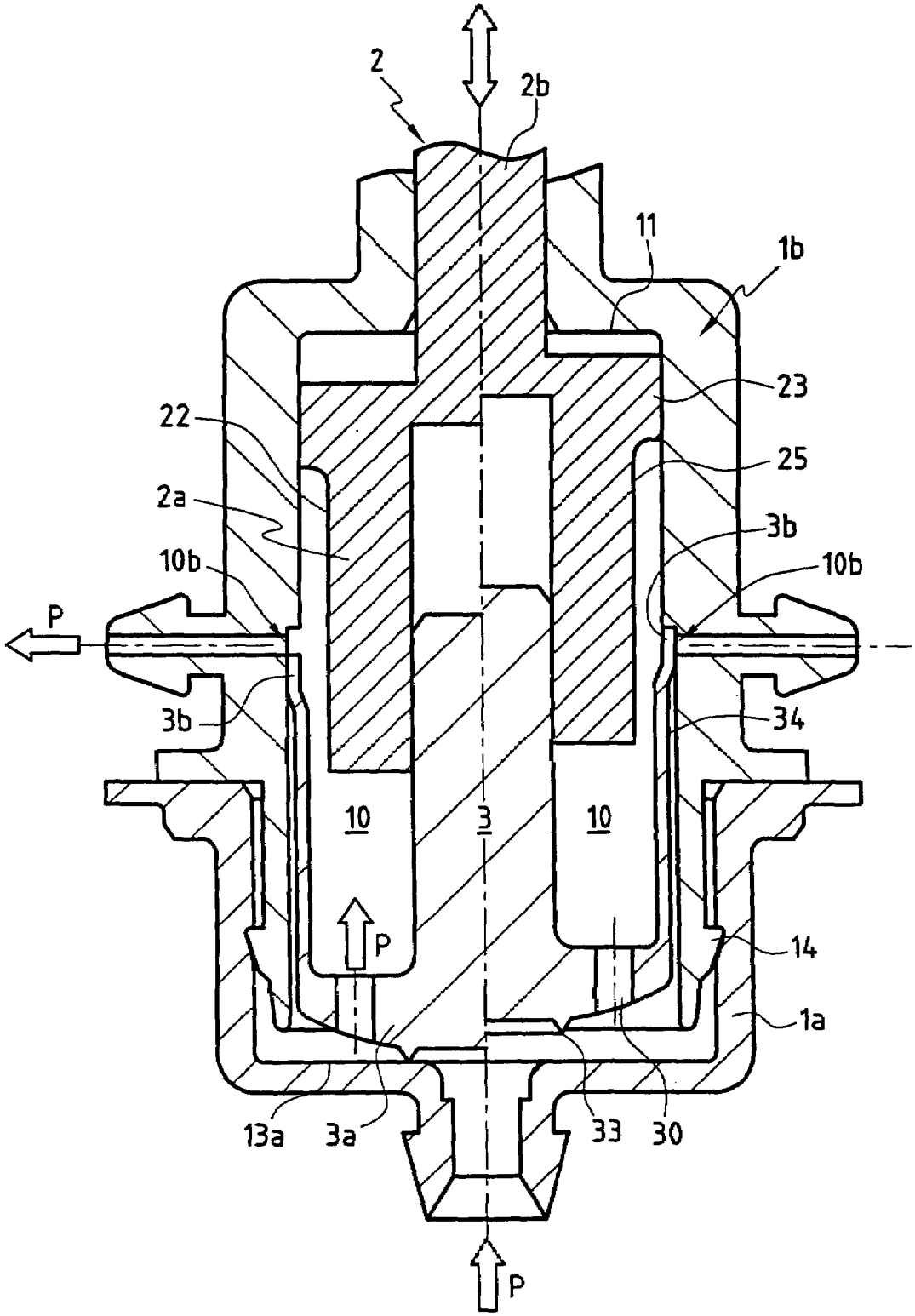
Figure 4:
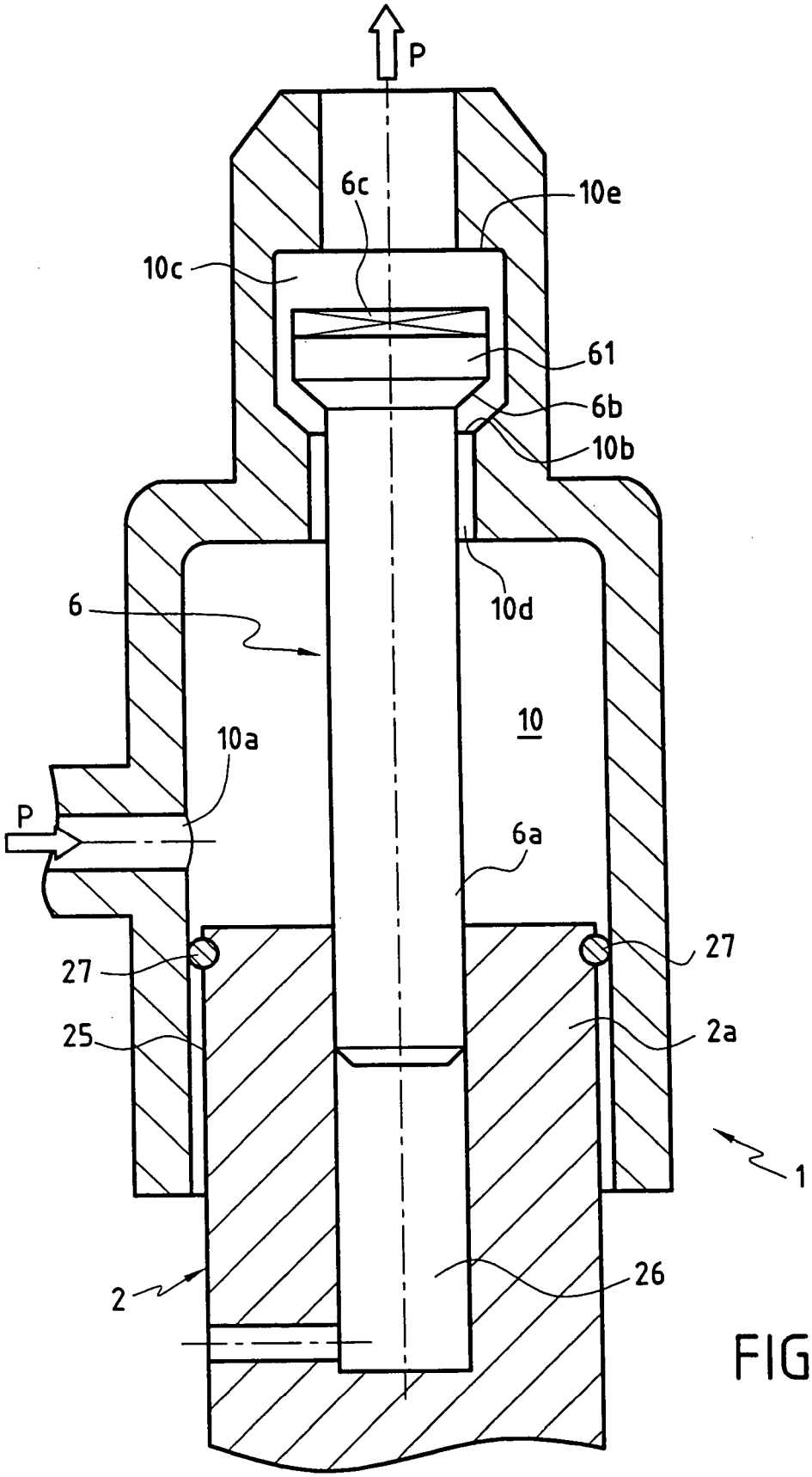
Figure 5:
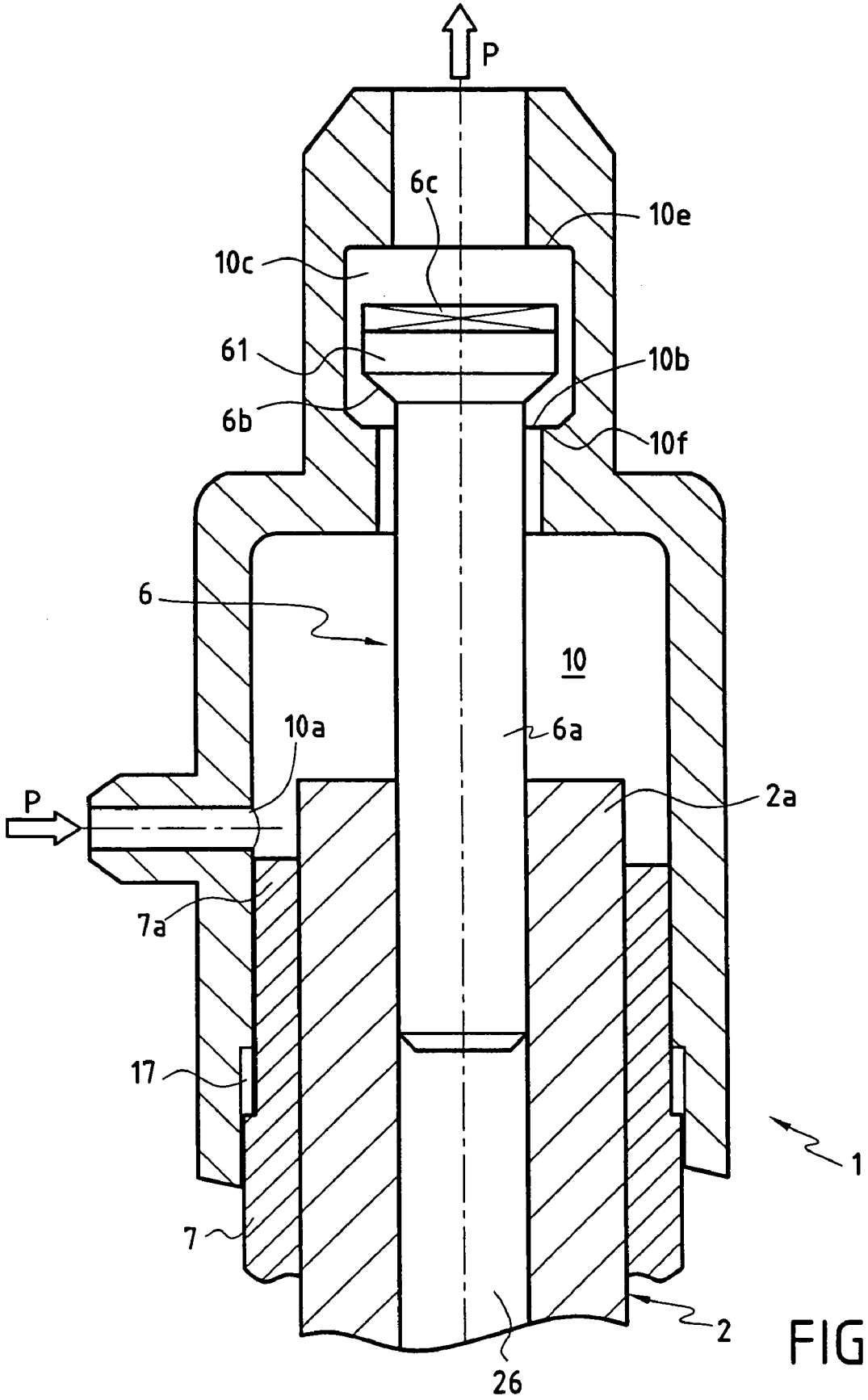
Figure 6:
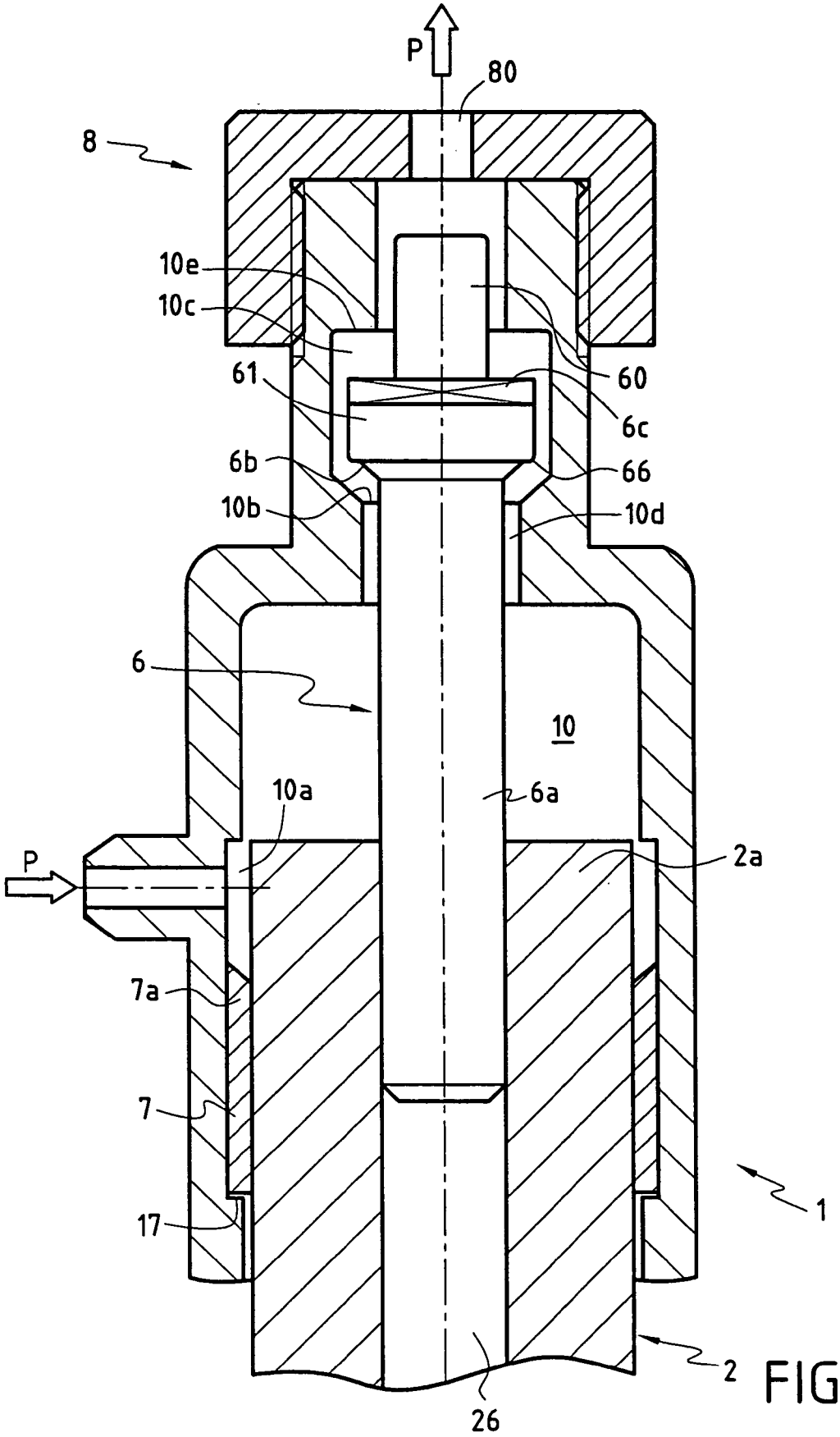

FIG. 3 comprises two half-views in section of a second variant of the FIG. 1 micropump in two distinct stages;

FIG. 4 is a diagrammatic section view of a second embodiment of the micropump of the invention;

FIG. 5 is a section view of a first variant of the FIG. 4 micropump; and FIG. 6 is a section view of a second variant of the FIG. 4 micropump.

The micropump shown in the figures is provided with a cylindrical body 1 enclosing a measuring chamber 10.

The chamber 10 is of variable volume since it is defined by a piston 2 whose end 2*a* can penetrate into the chamber.

The chamber 10 communicates firstly with a tank (not shown) via an inlet orifice 10*a* connected, where appropriate, to a dip tube 4, and secondly to the outside via an outlet orifice 10*b* which is connected in this case to a duct 5.

The inlet orifice 10*a* is provided with an inlet valve, while the outlet orifice 10*b* is provided with an outlet valve.

According to the invention, the piston 2 has its external portion 2*b* connected to a reciprocating actuator such as an electric micromotor and possibly to a transmission member (not shown) suitable for transforming rotary motion into translation and for communicating axial reciprocating motion to the piston. In conventional manner, this motion has the effect in the withdrawal direction of establishing suction in the chamber 10 and thus of sucking the liquid P in from the tank, and in the opposite direction (insertion direction) of compressing the liquid P via the inlet orifice 10*a* and of delivering it to the outside into the chamber via the outlet orifice 10*b*.

Nevertheless, unlike traditional pumps in which the piston is actuated manually by means of a pushbutton and returned to a high position by a return member, in this case the piston is moved in rapid reciprocating translation at high frequencies while delivering very small volumes of liquid P, and this requires special valves.

Still according to the invention, provision is made for at least one of the inlet and outlet valves to be constituted by a valve member capable of being driven in reciprocating translation by friction contact with the internal portion 2*a* of the piston 2, and thus the stroke inside the chamber 10 is shorter than the stroke of the piston.

This valve member has at least one wall for closing the inlet orifice 10*a* or the outlet orifice 10*b* periodically in leaktight manner.

In the embodiment of FIG. 1, the inlet orifice 10*a* is formed axially in the bottom of the chamber 10, while the outlet orifice 10*b* is formed through the side wall near the top of the body 1.

The piston 2 is in the form of a solid cylindrical rod having a chamfered bottom end.

The valve member is constituted in this case by a cylindrical and conical bushing 3 whose plane end wall 3*a* forms the inlet valve and whose cylindrical wall forming its top side edge 3*b* forms the outlet valve.

The bottom portion of the bushing 3 has at least one through slot 30 allowing the bushing to be filled with the liquid P during admission.

The internal portion 2*a* of the piston 2 is provided with fluting 20 and with a top peripheral lip 21 cooperating with a shoulder 11 of the body 1 to provide sealing and to form the top-of-stroke abutment.

The fluting 20 defines a cylindrical bearing surface which provides friction contact against the inside dynamic wall of the bushing 3.

The outside wall of the bushing 3 has guide ribs 31 in contact with the inside wall of the chamber 10.

The bottom 3*a* of the bushing 3 and in this case also its top rim 3*c*, carry respective peripheral beads 33 that come into leaktight abutment against the bottom 13*a* of the chamber 10 around the orifice 10*a* or against a top step 13*b* edging the orifice 10*b*.

The distance between the step 13*b* and the bottom 13*a* thus defines the axial stroke of the bushing 3 in the chamber 10. The stroke of the piston 2 is determined by the amplitude of the displacement of the actuator.

During the admission stage, the piston 2 is pulled axially out from the body 1, in this case upwards, by the actuator, and by friction it entrains the bushing 3 inside the chamber 10 away from the bottom 13*a*.

This displacement which constitutes the first stage of the operating cycle of the pump raises the bottom 3*a* of the bushing and releases the orifice 10*a*. The progressive withdrawal of the lip 21 of the piston 2 increases the empty volume of the chamber 10, thereby establishing suction which is quickly compensated by the liquid P entering via the orifice 10*a*. Simultaneously, the outlet orifice lob is closed by the top side wall 3*b* of the bushing 3, thus preventing any parasitic ingress of liquid that is to be found downstream from the outlet orifice. As it moves inside the chamber 10, the top end 3*b* of the bushing 3 remains in leaktight contact with the inside wall of the body 1.

Thus, the slots 30 constitute a path which the liquid P is constrained to follow going towards the orifice 10*b*.

When the bead 33 of the rim 3*c* reaches the step 13*b*, the bushing is prevented from moving by top abutments, but during a second stage the piston 2 can continue its upward stroke until its lip 21 comes into contact with the shoulder 11 of the body 1.

In this position, shown in FIG. 1, the entire inside volume of the chamber 10 is occupied by liquid P, including inside the bushing because of the slots 30, and around the piston because of the fluting 20.

The duration of this first two-stage stroke is abut 1/60th to 1/300th of a second, with a micromotor operating in the range 30 Hz to 150 Hz.

In the following delivery stroke, the piston 2 is pushed axially into the body 1 by the actuator. In a first stage, this movement is accompanied by the bushing 3 moving down inside the chamber 10 because of the friction contact connection.

As it moves down, the bushing 3 releases the outlet orifice 10*b* and opens the outlet valve. Under the pressure created by the piston 2, the liquid P then escapes via the duct 5. When the bead 33 of the bottom 3*a* reaches the bottom 13*a* of the chamber, the inlet valve closes and prevents any unwanted delivery of liquid through the orifice 10*a*.

Finally, in a second stage, the piston 2 continues its downward stroke and compresses the remaining liquid that is still in the chamber 10, which liquid then flows via the slot 30 and the fluting 20 to the orifice 10*b*, until the piston 2 reaches the end of its stroke.

At this moment, the four-stage cycle is terminated and a new admission stage in the following cycle can begin immediately.

Figure 2:
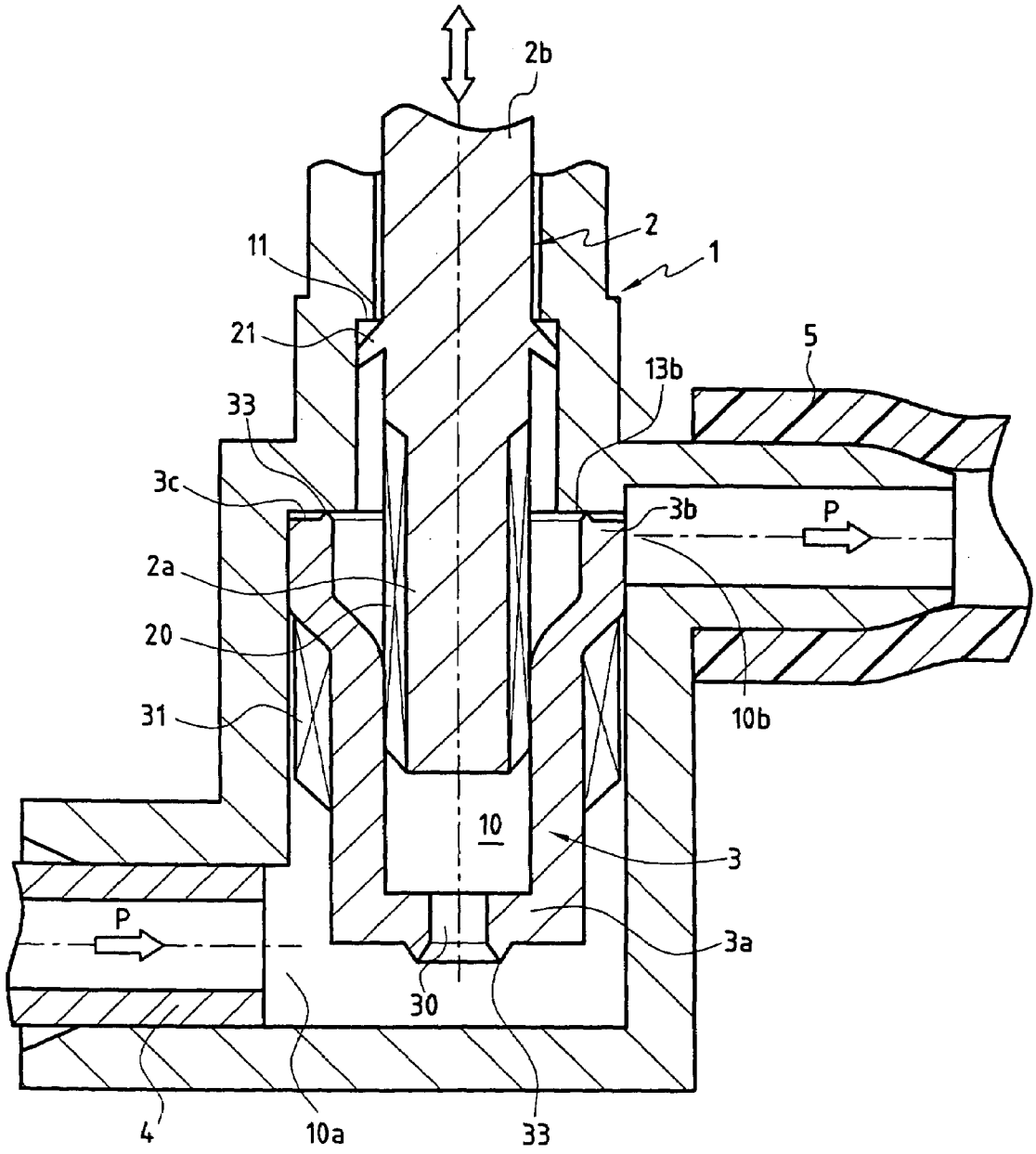
FIG. 2 is a section view of a first variant of the FIG. 1 micropump.

In the variant shown in FIG. 2, the inlet orifice 10*a* is made through the side wall of the chamber 10 like the outlet orifice 10*b*, but near the bottom thereof, and in this case on the diametrically opposite side.

The slot 30 is made centrally through the bottom 3*a* of the bushing 3.

This configuration is simpler to make, and can also be particularly advantageous from the point of view of overall size of the pump in the packaging device.

In the variant shown in FIG. 3, the body is made of two parts 1*a* and 1*b*, respectively a bottom part and a top part, which parts are united by snap-fastening members 14.

The left-hand half-view shows this variant in its position at the end of the delivery stage while the right-hand half-view shows it in the final position of the admission stage.

The internal portion of the piston 2 in this case is made in the form of a coupling sleeve 22 for fitting with friction over a cylindrical central hub 32 carried by the bushing 3. The piston 2 also comprises, in its top portion, a peripheral rib 23 in leaktight sliding contact with the inside wall of the chamber 10.

The top edge of the sleeve 22 is connected via a collar 24 to its external portion 2*b* which is coupled to the actuator.

The side wall 25 of the sleeve 22 leaves a gap relative to the side wall 34 of the bushing 3.

The top edge of the side wall 34 of the bushing 3 forms the valve member 3*b* of the outlet valve as in the variant described above. The inlet valve is constituted by the bottom 3*a* of the bushing provided with a peripheral bead 33 for surrounding the inlet orifice 10*a* coaxially in leaktight manner.

The slots 30 are made through the bottom 3*a* and radially outside the bead 33.

The valve member 3*b* of the outlet valve is radially offset from the side wall 34 of the bushing 3. The outside diameter of the bushing 3 is slightly greater than the inside diameter of the chamber 10 and because the side wall is flexible, the bushing 3 is received under elastic stress in the top part 1*b* of the body. Thus, when the wall 3*b* comes into register with the outlet orifice 10*b*, it presses in leaktight manner against said orifice like a plug, as shown in the right-hand half-view.

In the embodiment shown in FIG. 4, the outlet orifice 10*b* extends axially from the top of the chamber 10 while the inlet orifice 10*a* extends laterally.

The valve member of the outlet valve is constituted in this case by a rod 6 engaged firstly with friction in a central bore 26 of the piston 2 and provided, secondly, with a head 61 carrying a frustoconical wall 6*b* suitable during the admission stage for coming to bear in leaktight manner against the outlet orifice 10*b* which has a profile that is likewise frustoconical, thus forming a valve seat.

During the delivery stage, the head 61 of the valve comes into contact with the internal shoulder 10*e* via ribs or grooves 6*c* formed on the top of the head 61. These ribs or grooves 6*c* thus allow the liquid being delivered to pass through.

The maximum diameter of the head 61 is greater than that of the cylindrical body 6*a* of the rod 6.

The head 61 is held captive with freedom to move in translation inside a cavity 10*c* whose transverse walls thus form two end-of-stroke abutments and communicate with the chamber 10 via a cylindrical duct 10*d*.

The profile of the upstream transverse wall of the cavity 10*c* forming a valve seat and defining the outlet orifice 10*b* matches the frustoconical shape of the wall 6*b* of the head 61.

The valve member of the inlet valve is constituted by the side wall 25 of the piston 2 provided, where necessary, with peripheral gaskets 27.

In the first variant embodiment shown in FIG. 5, the valve member of the inlet valve is constituted by a sleeve 7 having the internal portion 2*a* of the piston 2 engaged coaxially therein with friction contact.

The sleeve 7 is made with two different diameters so as to co-operate with an annular peripheral shoulder 17 formed in the inside wall of the body 1 in order to limit the stroke of the sleeve.

The position of the shoulder 17 is determined in particular as a function of the height of the sleeve 7, so that during the delivery stage, the free edge 7*a* of the outside wall of the sleeve 7 can close the inlet orifice 10*a* in leaktight manner.

The piston 2 is thus in friction contact with two independent valve members, whose respective strokes can therefore be adjusted optimally.

During withdrawal of the piston 2, this variant thus makes it possible simultaneously to obtain continuous suction of the liquid P into the chamber 10, instead of the liquid being admitted overall at the end of the stroke.

Still in this variant, the delivery duct 10*b*, where it crosses the upstream wall of the cavity 10*c*, defines a wedge 10*f* providing, on contact with the wall 6*b*, a circular line of sealing when the outlet valve is in its closed position.

In the second variant embodiment shown in FIG. 6, the pump has a cap 8 removably fixed (by screw fastening or snap-fastening) on the top portion of the body 1. In this case, the head 61 is cylindrical in shape with a bead 66 that closes the outlet orifice 10*b* by leaktight contact with a circular line on the facing inclined wall. The cap 8 is provided with a spray orifice 80, and upstream therefrom with an array of swirling channels (not shown) formed in its inside wall.

In addition, the rod 6 of the outlet valve member is extended beyond the head 61 by a core 60 suitable for closing the swirling channels when in its high position during the delivery stage. The core 60 is made integrally with the rod 6 and extends the head 61.

When the pump is not in operation, the cap 8 is operated by screw fastening or snap-fastening, applying pressure to the core 60 which forces the wall 6*b* of the head of the rod into contact against the wall of the orifice 10*b*. This positive contact ensures overall sealing of the system regardless of the position in which the electrical actuator stops. However when the actuator stops, the piston 2 comes to rest in a position that is random.

The invention claimed is:

1. A micropump comprising a cylindrical body defining a measuring chamber defined by a piston and communicating firstly with a tank via an inlet orifice provided with an inlet valve, and secondly with the outside via an outlet orifice provided with an outlet valve, wherein the piston is connected to an external reciprocating actuator for actuation over a piston stoke, and wherein at least one of said valves comprises a valve member arranged to be driven in translation by friction contact with said piston successively in one direction and then in the other, said valve member having a stroke inside the measuring chamber that is shorter than the stroke of said piston.

2. The micropump according to claim 1, wherein said valve member comprises at least one wall arranged to close the outlet orifice or the inlet orifice periodically in a leaktight manner.

3. The micropump according to claim 2, wherein said wall is provided with a bead.

4. The micropump according to claim 1, wherein the outlet orifice is provided in a side wall of said body, and said valve member comprises a cylindrical and conical bushing having a bottom wall forming the inlet valve and a top side wall forming the outlet valve.

5. The micropump according to claim 4, wherein a bottom portion of said cylindrical and conical bushing includes at least one through slot.

6. The micropump according to claim 4, wherein the side wall of said cylindrical and conical bushing includes guide ribs in contact with an inside wall of the measuring chamber.

7. The micropump according to claim 4, wherein an internal portion of the piston is provided with side fluting and with a top lip providing sealing and a top-of-stroke abutment.

8. The micropump according to claim 4, wherein the bottom wall and/or the top wall of the cylindrical and conical bushing carries a peripheral bead coming into leaktight abutment downwards or upwards respectively against the inside wall of the measuring chamber.

9. The micropump according to claim 1, wherein the outlet orifice opens axially into said measuring chamber, and said valve member of the outlet valve comprises a rod engaged firstly with friction in a bore of the piston and provided secondly with a head having a transverse wall adapted to engage the axial outlet orifice in a leaktight manner.

10. The micropump according to claim 9, wherein said head is received inside a cavity having transverse walls that form end-of-stroke abutments.

11. The micropump according to claim 9, wherein the inlet orifice is provided in the side wall of said body and the valve member of the inlet valve comprises a sleeve which has the internal portion of the piston engaged in frictional contact therein.

12. The micropump according to claim 11, wherein said sleeve co-operates with an annular shoulder formed in an inside wall of the body to thereby limit its stroke.

* * * * *